US012628888B2

(12) United States Patent
Wu et al.

(10) Patent No.: US 12,628,888 B2
(45) Date of Patent: May 19, 2026

(54) ARC PROTECTION GARMENT

(71) Applicant: Guizhou Power Grid Co., Ltd., Guiyang (CN)

(72) Inventors: Jialong Wu, Guiyang (CN); Xi Fang, Guiyang (CN); Lei Huang, Guiyang (CN); Ying Liu, Guiyang (CN); Chaoping Xu, Guiyang (CN); Xufei Yang, Guiyang (CN); Shi Wang, Guiyang (CN); Qun Yu, Guiyang (CN); Wei Wu, Guiyang (CN); Xin Teng, Guiyang (CN); Xinxin Wang, Guiyang (CN); Chonglin Xiang, Guiyang (CN); Yudong Huang, Guiyang (CN); Jiawei Xu, Guiyang (CN); Yuxiong Xiao, Guiyang (CN); Junwen Long, Guiyang (CN); Qian Xiao, Guiyang (CN); Ruiyang Wu, Guiyang (CN); Fengyi Deng, Guiyang (CN); Xiangyue Dai, Guiyang (CN); Dan Jiang, Guiyang (CN); Yuan Huang, Guiyang (CN); Siyuan Chen, Guiyang (CN); Hailu Zhang, Guiyang (CN)

( * ) Notice: Subject to any disclaimer, the term of this patent is extended or adjusted under 35 U.S.C. 154(b) by 0 days.

(21) Appl. No.: 19/170,399

(22) Filed: Apr. 4, 2025

(65) Prior Publication Data

US 2026/0000133 A1 Jan. 1, 2026

(30) Foreign Application Priority Data

Jun. 27, 2024 (CN) ..... 202410849678.0

(51) Int. Cl.
*A41D 13/008* (2006.01)
*A41D 27/12* (2006.01)

(52) U.S. Cl.
CPC ..... *A41D 13/008* (2013.01); *A41D 27/12* (2013.01)

(58) Field of Classification Search
CPC ..... A41D 13/008; A41D 27/12
See application file for complete search history.

(56) References Cited

U.S. PATENT DOCUMENTS

2012/0117701 A1* 5/2012 Lamb ..... F41H 1/02 2/2.5
2012/0240300 A1* 9/2012 Pittman ..... F41H 13/0025 2/2.5
2024/0145109 A1* 5/2024 Mustapha ..... A41D 13/08

* cited by examiner

*Primary Examiner* — Katherine M Moran

(57) ABSTRACT

The present invention relates to the technical field of arc protection garments, in particular to an arc protection garment. The arc protection garment comprises: an arc protection garment body; a detachable fixed component comprising a fixed frame, a limit frame, an elastic member connection groove, and an opening; a protective plate; and a limit component comprising a movable frame and a sliding rack. The fixed plate is pulled to drive the sliding rack to move down, a limit rod descends and separates from a connection hook, and the protective plate can be quickly removed without turning over an injured person for emergency handling.

10 Claims, 4 Drawing Sheets

ARC PROTECTION GARMENT

CROSS-REFERENCE TO RELATED APPLICATIONS

The present application claims priority to Chinese Patent Application No. 202410849678.0, filed on Jun. 27, 2024, the entire disclosure of which is incorporated herein by reference.

TECHNICAL FIELD

The present invention relates to the technical field of arc protection garments, in particular to an arc protection garment.

BACKGROUND

An arc protection garment, multifunctional work clothes designed specifically for extreme electrical working environments, is a perfect combination of safety and technology. It not only has key protective properties such as flame retardancy, thermal insulation, static protection, and arc explosion prevention, but also shows thoughtful design, to ensure that these life protection functions never diminish or deteriorate even after washing. Special high-strength and low-elongation bulletproof fibers are embedded in its high-tech fabric. These fibers can rapidly expand when exposed to arc flames or high temperatures, to instantly thicken the fabric and increase its density, thereby building a sturdy human body protection barrier that effectively isolates heat energy and ensures the safety of workers.

In order to further improve the protective effect, some work clothes are provided with detachable metal or ceramic protective plates in key parts, such as the chest, back, arms, and legs. The design of these protective plates aims to provide additional protection, but brings some potential challenges.

Two connection straps are usually equipped on the protective plate, with connectors at two ends. The protective plate can be mounted on a user by binding the connection straps to the body and connecting the connectors on the two connection straps. Although this design facilitates quick removal of the protective plate, inconvenience may be brought in emergencies, such as when the user is injured and the protective equipment needs to be quickly removed. To remove the protective plate, the user needs to be turned over to open the connectors on the back, which not only increases the complexity of operation but may also increase the risk of secondary injury to the user

SUMMARY

In view of the problems existing in the prior art, the present invention is proposed.

To solve the above technical problems, the present invention provides the following technical solution: An arc protection garment includes:

an arc protection garment body;

a detachable fixed component arranged on the arc protection garment body and including a fixed frame, a limit frame arranged on an inner wall of the fixed frame, an elastic member connection groove formed on an outer wall of the fixed frame, and an opening formed on one side of the fixed frame;

a protective plate; and a limit component including a movable frame and a sliding rack in sliding connection with an inner wall of the movable frame.

As a preferred embodiment of the arc protection garment according to the present invention, the protective plate includes a front plate, a back plate connected to an outer wall of the front plate, and a connection hook connected to an outer wall of the back plate.

As a preferred embodiment of the arc protection garment according to the present invention, the outer wall of the front plate is in sliding connection with the inner wall of the fixed frame, and the outer wall of the back plate is in sliding connection with an outer wall of the limit frame.

As a preferred embodiment of the arc protection garment according to the present invention, a first elastic member is mounted on the inner wall of the movable frame, and a top of the first elastic member is connected to an outer wall of the sliding rack.

As a preferred solution of the arc protection garment according to the present invention, a limit rod is mounted on the outer wall of the sliding rack, a fixed plate is mounted at a bottom of the sliding rack, and a connection port is formed on the outer wall of the front plate.

As a preferred solution of the arc protection garment according to the present invention, an outer wall of the fixed plate is in sliding connection with a bottom of the movable frame, an outer wall of the connection hook is in sliding connection with an inner wall of the connection port, and one side of the connection hook is clamped with one side of the limit rod.

As a preferred embodiment of the arc protection garment according to the present invention, an outer wall of the movable frame is in sliding connection with the inner wall of the fixed frame, a second elastic member is provided on one side of the movable frame, and one side of the second elastic member is in contact with an outer wall of the elastic member connection groove.

As a preferred embodiment of the arc protection garment according to the present invention, a clamping groove is formed on one side of the back plate, a connection component is connected to the clamping groove, and the connection component includes a connection strap and a connection block arranged on one side of the connection strap.

As a preferred solution of the arc protection garment according to the present invention, a clamping block is mounted on one side of the connection block, the clamping groove is convex, and an outer wall of the clamping block is clamped with an inner wall of the clamping groove.

As a preferred solution of the arc protection garment according to the present invention, an outer wall of the connection block is in sliding connection with an inner wall of the opening.

Beneficial effects of the present invention are as follows: In the event of an emergency, the fixed plate is pulled to drive the sliding rack to move down, the limit rod descends and separates from the connection hook, and the protective plate can be quickly removed without turning over an injured person for emergency handling.

Meanwhile, under normal circumstances, the protective plate is continuously pressed to drive air into the fixed frame, so that the air inside the fixed frame and the arc protection garment body is circulated to dissipate the heat inside the fixed frame and the arc protection garment.

BRIEF DESCRIPTION OF DRAWINGS

To describe the technical solutions in embodiments of the present invention more clearly, the following briefly describes the accompanying drawings required for describing the embodiments. Apparently, the accompanying drawings in the following descriptions show merely some embodiments of the present invention, and those of ordinary skill in the art can derive other drawings from these accompanying drawings without creative efforts.

DETAILED DESCRIPTION OF THE EMBODIMENTS

In order to make the above objectives, features and advantages of the present invention more obvious and understandable, specific embodiments of the present invention will be described in detail below with reference to the accompanying drawings of the specification.

Many specific details are set forth in the following description to facilitate a full understanding of the present invention, but the present invention can also be implemented in other ways different from those described here, and those skilled in the art can do similar promotions without departing from the connotation of the present invention. Therefore, the present invention is not limited by the specific embodiments disclosed below.

Secondly, the term "one embodiment" or "embodiments" referred to here refers to specific features, structures, or features that may be included in at least one implementation of the present invention. The term "in one embodiment" appearing in different places of this specification neither necessarily refers to the same embodiment, nor is a separate or selective embodiment exclusive with other embodiments.

Embodiment 1

Figure 1:
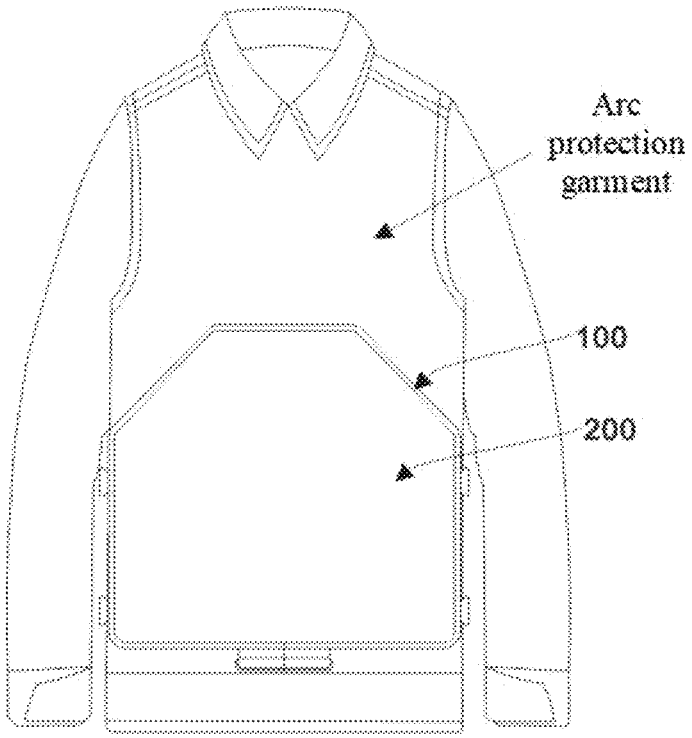
FIG. 1 is a schematic diagram of an overall structure in the present invention.
Figure 2:
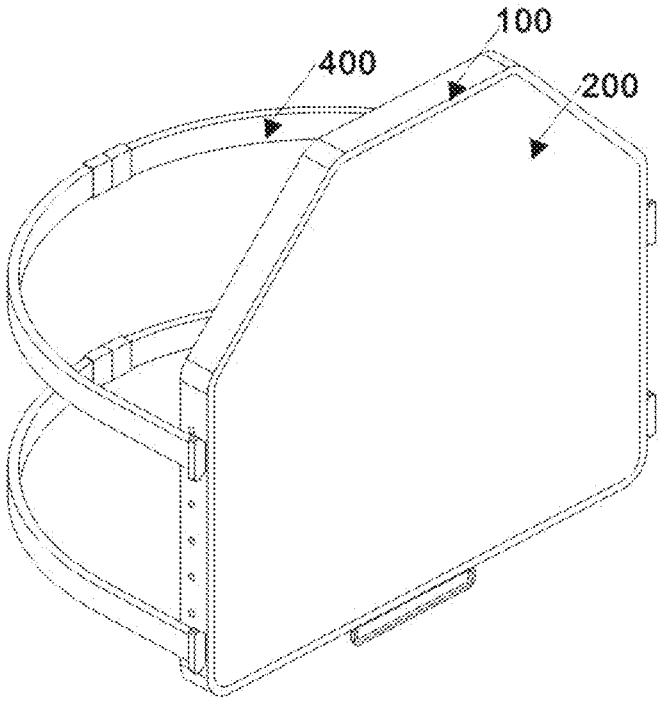
FIG. 2 is a schematic diagram of connection of a fixed component, a protective plate, and a connection component in the present invention.
Figure 3:
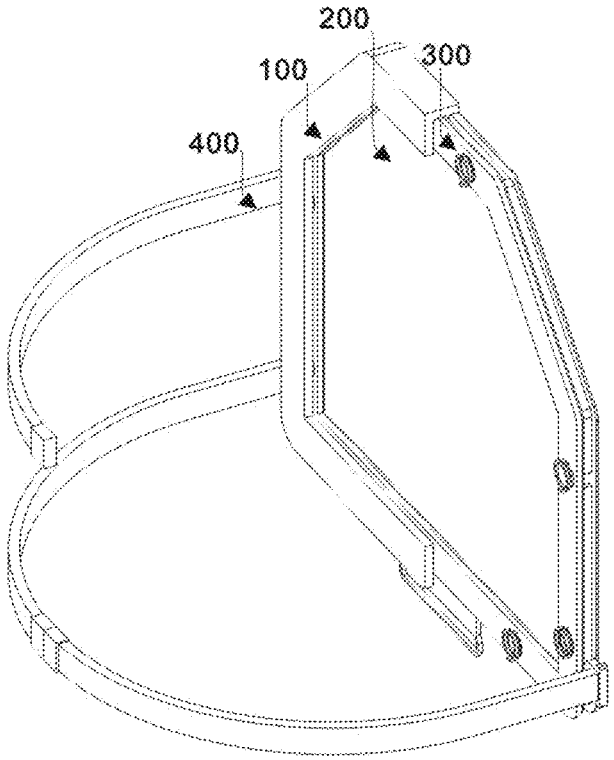
FIG. 3 is a schematic diagram of connection of the fixed component, the protective plate, a limit component, and the connection component in the present invention.
Figure 4:
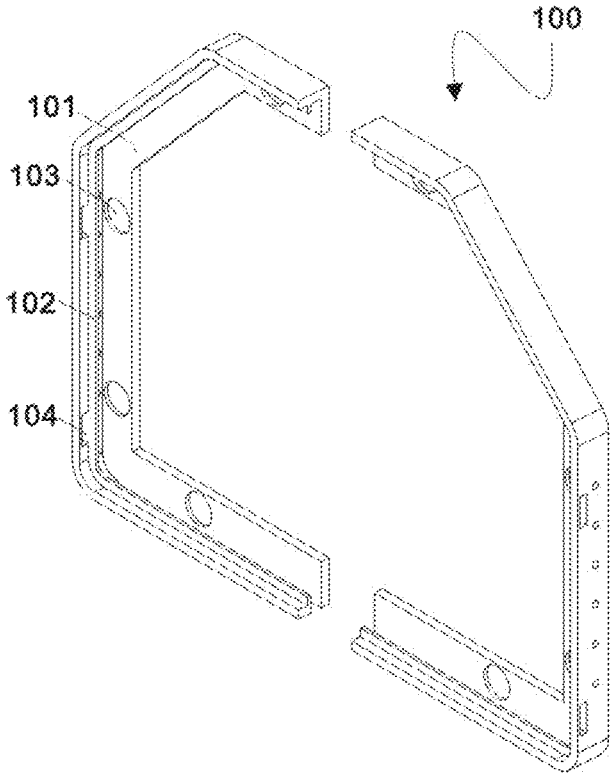
FIG. 4 is a schematic structural diagram of the fixed component in the present invention.
Figure 5:
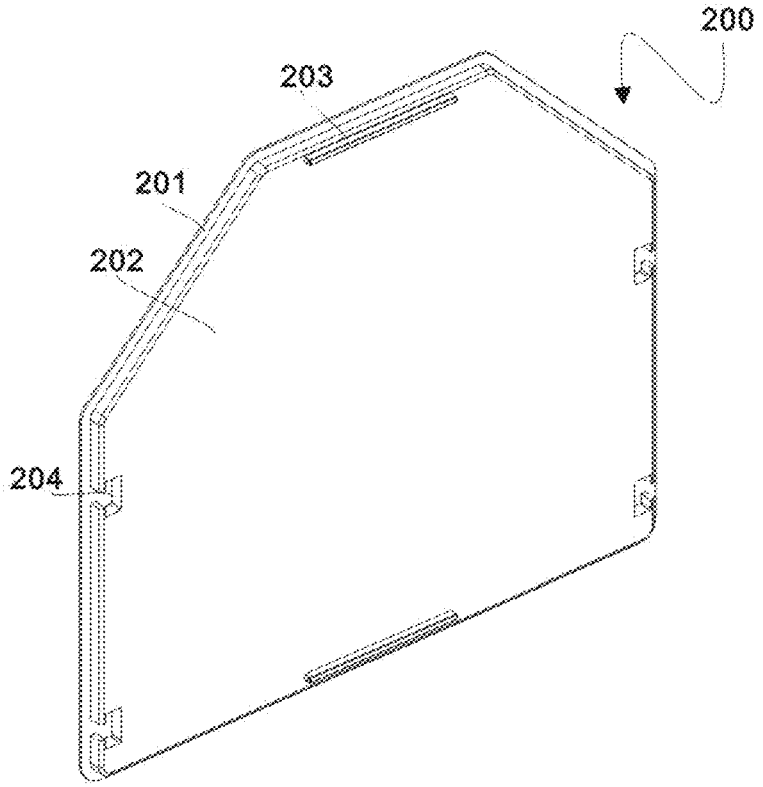
FIG. 5 is a schematic structural diagram of the protective plate in the present invention.
Figure 6:
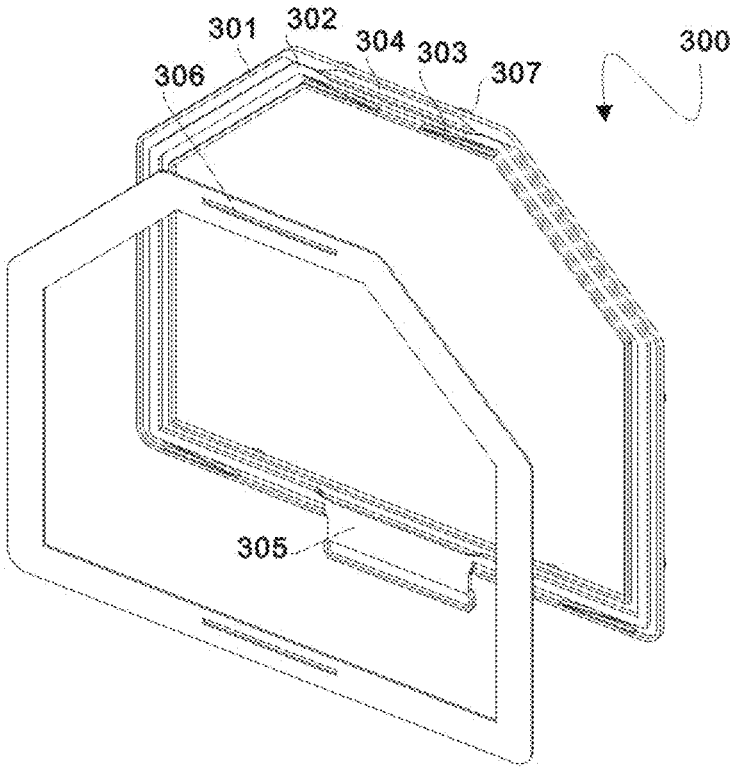
FIG. 6 is a schematic structural diagram of the limit component in the present invention.
Figure 7:
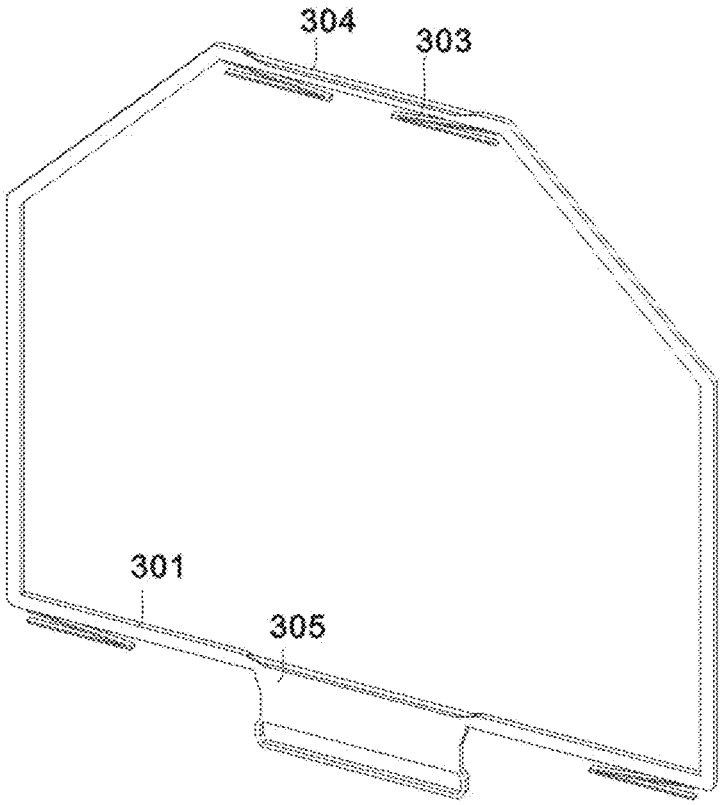
FIG. 7 is a schematic structural diagram of parts of the limit component in the present invention.
Figure 8:
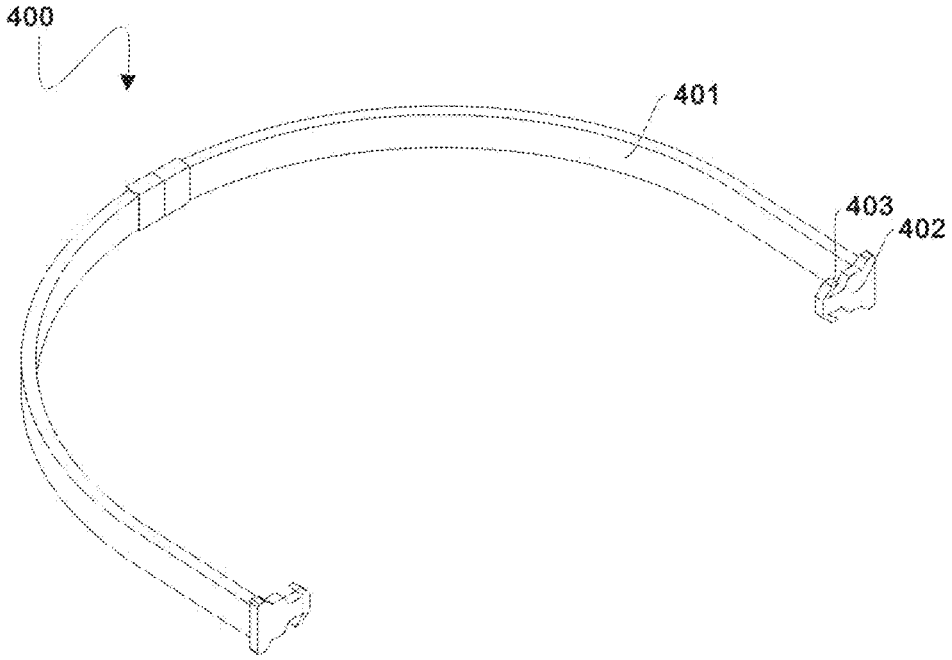
FIG. 8 is a schematic structural diagram of the connection component in the present invention.

FIG. 1 to FIG. 8 show a first embodiment of the present invention. This embodiment provides an arc protection garment. The arc protection garment is equipped with a fixed component 100 and a protective plate 200 to strengthen the protection on a user. Meanwhile, a limit component 300 is provided inside the fixed component 100, so that an operator can quickly disassemble the protective plate 200 without turning over an injured person;

Specifically, the arc protection garment includes an arc protection garment body; a detachable fixed component 100 arranged on the arc protection garment body and including a fixed frame 101, a limit frame 102 arranged on an inner wall of the fixed frame 101, an elastic member connection groove 103 formed on an outer wall of the fixed frame 101, and an opening 104 formed on one side of the fixed frame 101; a protective plate 200; and a limit component 300 including a movable frame 301 and a sliding rack 302 in sliding connection with an inner wall of the movable frame 301.

The protective plate 200 includes a front plate 201, a back plate 202 connected to an outer wall of the front plate 201, and a connection hook 203 connected to an outer wall of the back plate 202, where the area of the front plate 201 is greater than that of the back plate 202, and the shapes of the two are the same as the shape of the fixed frame 101;

It should be noted that the front plate 201 here may be provided with heat dissipation holes and grooves on its surface as needed for heat dissipation and easy access to the front plate 201.

The outer wall of the front plate 201 is in sliding connection with the inner wall of the fixed frame 101, and the outer wall of the back plate 202 is in sliding connection with an outer wall of the limit frame 102, where the area of a middle hole portion of the limit frame 102 is less than that of the front plate 201, so when the front plate 201 is pressed to move, the front plate 201 will be blocked by the limit frame 102 after moving a period of time and cannot continue to move.

A first elastic member 303 is mounted on the inner wall of the movable frame 301, and a top of the first elastic member 303 is connected to an outer wall of the sliding rack 302, where the first elastic member 303 is a bent elastic piece, the movable frame 301 is trapezoidal with the first elastic members 303 on its upper and lower parts, the sliding rack 302 is also trapezoidal, and the upper and lower parts of the sliding rack 302 are connected to the corresponding first elastic members 303.

An outer wall of the fixed plate 305 is in sliding connection with a bottom of the movable frame 301, an outer wall of the connection hook 203 is in sliding connection with an inner wall of a connection port 306, and one side of the connection hook 203 is clamped with one side of a limit rod 304. Two connection hooks 203 are configured, the two connection hooks 203 are arranged on the surface of the back plate 202 away from the front plate 201 and on the upper and lower sides of that surface respectively, and openings of the two connection hooks 203 are downward.

The limit rod 304 is mounted on the outer wall of the sliding rack 302, a fixed plate 305 is mounted at a bottom of the sliding rack 302, and the connection port 306 is formed on the outer wall of the front plate 201. Two limit rods 304 are configured, and the two limit rods 304 are arranged on the upper and lower sides of the sliding rack 302 respectively. The connection hooks 203 squeeze the limit rods 304 after entering the connection ports 306, so that the sliding rack 302 moves down. Then, when the openings of the connection hooks 203 move to the limit rods 304, the limit rods 304 are clamped with the connection hooks 203 to connect the protective plate 200 with the limit component 300;

An opening wider than the fixed plate 305 is provided at a bottom of the fixed frame 101, the fixed plate 305 is located in the opening, and when the limit component 300 moves, the fixed plate 305 is driven to move in the opening;

It should be noted that, in emergencies, the fixed plate 305 is pulled to drive the sliding rack 302 to move down, the limit rods 304 can be separated from the connection hooks 203, and the protective plate 200 can be quickly removed for emergency handling.

An outer wall of the movable frame 301 is in sliding connection with the inner wall of the fixed frame 101, a second elastic member 307 is provided on one side of the movable frame 301, and one side of the second elastic member 307 is in contact with an outer wall of the elastic member connection groove 103, where the second elastic member 307 is a threaded spring.

In summary, in the event of an emergency, the fixed plate 305 is pulled to drive the sliding rack 302 to move down, the second elastic member 303 is squeezed, the limit rods 304 descend and separate from the connection hooks 203, and the protective plate 200 can be removed for emergency handling.

Embodiment 2

FIG. 1 to FIG. 8 show a second embodiment of the present invention. This embodiment is based on the previous embodiment. The difference is that this embodiment provides a method for dissipating heat in the arc protection garment by the protective plate 200 under normal circumstances.

Specifically, the arc protection garment includes a fixed frame 101, a limit frame 102 arranged on an inner wall of the fixed frame 101, an elastic member connection groove 103 formed on an outer wall of the fixed frame 101, and an opening 104 formed on one side of the fixed frame 101; a protective plate 200; and a limit component 300 including a movable frame 301 and a sliding rack 302 in sliding connection with an inner wall of the movable frame 301, where the area of one side of the fixed frame 101 is less than that of the other side, the movable frame 301 is located on the smaller side, and the protective plate 200 is located on the larger side. Here, the area of the movable frame 301 is greater than that of the smaller side of the movable frame 301. Meanwhile, the other side of the movable frame 301 is blocked by the limit frame 102 from moving towards the smaller side of the movable frame 301.

The outer wall of the front plate 201 is in sliding connection with the inner wall of the fixed frame 101, and the outer wall of the back plate 202 is in sliding connection with the outer wall of the limit frame 102, where a plurality of heat dissipation holes are provided on two sides of the fixed frame 101.

The outer wall of the movable frame 301 is in sliding connection with the inner wall of the fixed frame 101, a second elastic member 307 is provided on one side of the movable frame 301, and one side of the second elastic member 307 is in contact with the outer wall of the elastic member connection groove 103, where the second elastic member 307 is a threaded spring. When the protective plate 200 is pushed, the limit component 300 is driven to move, to squeeze the second elastic member 307.

The outer wall of the fixed plate 305 is in sliding connection with the bottom of the movable frame 301, the outer wall of the connection hook 203 is in sliding connection with the inner wall of the connection port 306, and one side of the connection hook 203 is clamped with one side of the limit rod 304. When the connection hook 203 is clamped with the limit rod 304, the protective plate 200 cannot be separated from the limit component 300.

In summary, under normal circumstances, the protective plate 200 can be continuously pressed to drive air into the fixed frame 101 and push the existing air inside the fixed frame 101 away from the fixed frame 101, thereby exchanging the air inside the fixed frame 101 and circulating the air inside the fixed frame 101 and the arc protection garment body to dissipate the heat inside the fixed frame 101 and the arc protection garment.

Embodiment 3

FIG. 1 to FIG. 8 show a third embodiment of the present invention. This embodiment is based on the previous embodiment. The difference is that this embodiment provides a method for quickly disassembling the fixed frame 101.

Specifically, a clamping groove 204 is formed on one side of the back plate 202, a connection component 400 is connected to the clamping groove 204, and the connection component 400 includes a connection strap 401 and a connection block 402 arranged on one side of the connection strap 401, where the connection strap 401 is detachable and its main body is divided into two portions. Meanwhile, the connection block 402 is provided on each of the two portions of the connection strap 401, and a connector is provided on the side of each of the two portions of the connection strap 401 away from the connection block 402.

A clamping block 403 is mounted on one side of the connection block 402, the clamping groove 204 is convex, an outer wall of the clamping block 403 is clamped with an inner wall of the clamping groove 204, and an outer wall of the connection block 402 is in sliding connection with an inner wall of the opening 104, where the clamping block 403 has elasticity. When the clamping block 403 enters the clamping groove 204, the clamping block 403 is squeezed by a narrow portion of the clamping groove 204. The clamping block 403 is expanded when moving to a wide portion of the clamping groove 204.

In summary, when the entire protective plate 200 is removed, the clamping groove 204 is not connected to the clamping block 403, so the connection block 402 can be quickly removed, and the fixed frame 101 can be separated from the connection strap 401 without turning over the wearer.

It is important to note that the construction and arrangement of the present application shown in multiple different exemplary embodiments are only illustrative. Although only several embodiments are described in detail in the disclosure, those who refer to the disclosure should easily understand that many modifications are possible (such as the size, scale, structure, shape and proportion of various elements, parameter values (such as temperature and pressure), installation and arrangement, use of materials, colors, and directional changes), without deviating from the novel teachings and advantages of the subject matter described in the application. For example, elements shown as integrally formed may be composed of multiple portions or elements, positions of the elements may be inverted or otherwise changed, and the properties or number or position of discrete elements may be changed or altered. Therefore, all such modifications are intended to fall within the scope of the present invention. The order or sequence of any process or method step may be changed or reordered according to alternative embodiments. In the claims, any provision of "device plus function" is intended to cover the structure described herein that performs the function, and is not only structurally equivalent but also equivalent. Other substitutions, modifications, changes, and omissions may be made in the design, operation status, and arrangement of the exemplary embodiments without departing from the scope of the present invention. Therefore, the present invention is not limited to specific embodiments, but extends to various modifications that still fall within the scope of the appended claims.

Moreover, in order to provide concise descriptions of the exemplary embodiments, all features (namely, those features unrelated to the currently considered optimal mode of executing the present invention, or those features unrelated to the implementation of the present invention) of the actual embodiments may not be described.

It should be understood that in the development process of any practical implementation, such as in any engineering or design project, a large number of specific implementation decisions can be made. Such development efforts may be complex and time-consuming, but for ordinary technical personnel who benefit from the disclosure, excessive experimentation is not required, and the development efforts will be a routine task of design, manufacturing, and production.

It should be noted that the above embodiments are merely used for illustrating, but not limiting, the technical solutions of the present invention. Although the present invention is described in detail with reference to preferred embodiments, those of ordinary skill in the art should understand that the technical solutions of the present invention can be modified or equivalently substituted without departing from the spirit and scope of the technical solutions of the present invention, and all the modifications and equivalent substitutions should fall within the scope of the claims of the present invention.

What is claimed is:

1. An arc protection garment, comprising:

an arc protection garment body;

a detachable fixed component arranged on the arc protection garment body and comprising a fixed frame, a limit frame arranged on an inner wall of the fixed frame, an elastic member connection groove formed on an outer wall of the fixed frame, and an opening formed on one side of the fixed frame;

a protective plate; and a limit component comprising a movable frame and a sliding rack in sliding connection with an inner wall of the movable frame.

2. The arc protection garment according to claim 1, wherein the protective plate comprises a front plate, a back plate connected to an outer wall of the front plate, and a connection hook connected to an outer wall of the back plate.

3. The arc protection garment according to claim 2, wherein the outer wall of the front plate is in sliding connection with the inner wall of the fixed frame, and the outer wall of the back plate is in sliding connection with an outer wall of the limit frame.

4. The arc protection garment according to claim 3, wherein a first elastic member is mounted on the inner wall of the movable frame, and a top of the first elastic member is connected to an outer wall of the sliding rack.

5. The arc protection garment according to claim 4, wherein a limit rod is mounted on the outer wall of the sliding rack, a fixed plate is mounted at a bottom of the sliding rack, and a connection port is formed on the outer wall of the front plate.

6. The arc protection garment according to claim 5, wherein an outer wall of the fixed plate is in sliding connection with a bottom of the movable frame, an outer wall of the connection hook is in sliding connection with an inner wall of the connection port, and one side of the connection hook is clamped with one side of the limit rod.

7. The arc protection garment according to claim 6, wherein an outer wall of the movable frame is in sliding connection with the inner wall of the fixed frame, a second elastic member is provided on one side of the movable frame, and one side of the second elastic member is in contact with an outer wall of the elastic member connection groove.

8. The arc protection garment according to claim 7, wherein a clamping groove is formed on one side of the back plate, a connection component is connected to the clamping groove, and the connection component comprises a connection strap and a connection block arranged on one side of the connection strap.

9. The arc protection garment according to claim 8, wherein a clamping block is mounted on one side of the connection block, the clamping groove is convex, and an outer wall of the clamping block is clamped with an inner wall of the clamping groove.

10. The arc protection garment according to claim 9, wherein an outer wall of the connection block is in sliding connection with an inner wall of the opening.

* * * * *